US012796837B2

(12) United States Patent
Horvath et al.

(10) Patent No.: US 12,796,837 B2
(45) Date of Patent: Nov. 17, 2026

(54) THEFT DETERRENT SYSTEM

(71) Applicant: SENNCO SOLUTIONS INC., Plainfield, IL (US)

(72) Inventors: Daniel L. Horvath, Plainfield, IL (US); Andy Reynolds, Aurora, IL (US); Grace L. Dant, Morris, IL (US); Christopher Marszalek, Plainfield, IL (US)

(73) Assignee: SENNCO SOLUTIONS INC., Plainfield, IL (US)

( * ) Notice: Subject to any disclaimer, the term of this patent is extended or adjusted under 35 U.S.C. 154(b) by 0 days.

(21) Appl. No.: 19/034,880

(22) Filed: Jan. 23, 2025

(65) Prior Publication Data

US 2025/0235015 A1 Jul. 24, 2025

Related U.S. Application Data

(60) Provisional application No. 63/624,095, filed on Jan. 23, 2024.

(51) Int. Cl.
*A47F 3/00* (2006.01)
*A47F 5/00* (2006.01)

(52) U.S. Cl.
CPC ..... *A47F 3/002* (2013.01); *A47F 5/0043* (2013.01)

(58) Field of Classification Search
CPC ..... A47F 3/002; A47F 7/024; A47F 5/0093; A47F 5/00431; A47F 5/0043
USPC ..... 211/162
See application file for complete search history.

(56) References Cited

U.S. PATENT DOCUMENTS 2,371,433 A * 3/1945 Davis ..... B25H 3/04 211/94.01
2,430,624 A * 11/1947 Gustav ..... A47G 29/08 211/89.01
3,002,630 A * 10/1961 Heisser ..... A47K 1/09 248/110
3,468,509 A * 9/1969 Foltz ..... E05D 15/0652 211/162
3,690,130 A * 9/1972 Eutzler ..... E05B 69/006 70/59

(Continued)

FOREIGN PATENT DOCUMENTS

DE 2854366 A1 * 7/1980
DE 19950448 A1 * 4/2001 ..... A47F 7/024

(Continued)

OTHER PUBLICATIONS

PCT International Search Report, Form PCT/ISA/210, for International Application PCT/US2025/012702, Jun. 3, 2025 (5 pages).

(Continued)

*Primary Examiner* — Stanton L Krycinski
(74) *Attorney, Agent, or Firm* — Pauley Erickson & Swanson

(57) ABSTRACT

A theft deterrent system for mounting on a retail shelf includes a channel assembly configured to attach to a retail shelf. One or more brackets are positioned along the channel assembly, the brackets fixed within the channel assembly when the channel assembly is in a closed position. One or more corresponding stages are configured to connect to a retail product, where each stage is attached to a respective bracket.

21 Claims, 8 Drawing Sheets

(56) References Cited

U.S. PATENT DOCUMENTS 3,695,452 A * 10/1972 Surman ..... A47F 7/024 248/116
4,204,601 A * 5/1980 Thomas ..... E05B 69/006 211/124
4,209,098 A * 6/1980 Adams ..... A47F 5/0853 248/513
4,300,690 A * 11/1981 Thomas ..... A47F 7/024 211/124
4,336,885 A * 6/1982 Thomas ..... A47F 7/024 70/59
4,566,597 A * 1/1986 Caputo ..... A47K 1/09 248/110
5,224,610 A * 7/1993 Veazey ..... G09F 7/10 211/162
5,259,519 A * 11/1993 Lieberman ..... A47K 1/09 211/94.01
5,692,817 A * 12/1997 Jun ..... A47B 46/00 211/151
7,007,912 B1 3/2006 Giuliani et al.
7,028,854 B1 * 4/2006 Londrico ..... A47B 81/005 211/89.01
7,921,615 B2 * 4/2011 Picchio ..... E04B 2/74 211/94.01
8,070,378 B2 * 12/2011 Gargaro, III ..... A01K 97/10 248/225.11
D679,209 S * 4/2013 Reynolds ..... D10/106.91
9,125,501 B2 * 9/2015 Reynolds ..... A47F 7/024
9,615,677 B2 * 4/2017 Trinh ..... A47F 5/0043
10,051,980 B2 * 8/2018 Galant ..... A47F 7/00
10,349,758 B2 * 7/2019 Haroush ..... A47F 7/022
10,603,785 B1 * 3/2020 Hsieh ..... B25H 3/003
11,450,185 B2 * 9/2022 Helman ..... A47F 5/00
12,285,120 B2 * 4/2025 Smith ..... A47F 3/002
2005/0189369 A1 * 9/2005 Vlastakis ..... G07F 11/42 221/123
2005/0284832 A1 * 12/2005 Gerstner ..... A47F 5/0846 211/162
2008/0246375 A1 * 10/2008 Berg ..... A47B 47/0066 312/265.5
2010/0326930 A1 * 12/2010 Chiang ..... F16M 11/08 211/162
2014/0016503 A1 1/2014 Altekar et al.
2014/0027390 A1 * 1/2014 Reynolds ..... A47F 7/024 248/551
2015/0173530 A1 * 6/2015 Keyvanloo ..... A47F 5/0853 211/162
2015/0243193 A1 8/2015 Trinh et al.
2017/0124357 A1 5/2017 Leyden
2018/0092472 A1 4/2018 Haroush
2022/0248870 A1 * 8/2022 Tewksbury ..... G06F 1/1679
2023/0018293 A1 * 1/2023 Denby ..... E05D 7/0423

FOREIGN PATENT DOCUMENTS

FR 2668197 A1 * 4/1992 ..... E05B 69/006
FR 2744348 A1 * 8/1997 ..... A47F 7/024
GB 2058560 A * 4/1981 ..... A47F 69/006
WO WO-2017112749 A1 * 6/2017 ..... G08B 25/008
WO WO-2018020521 A1 * 2/2018 ..... G08B 25/00

OTHER PUBLICATIONS

PCT Written Opinion of the International Searching Authority, Form PCT/ISA/237, for International Application PCT/US2025/012702, Jun. 3, 2025 (8 pages).

* cited by examiner

THEFT DETERRENT SYSTEM

CROSS REFERENCE TO RELATED APPLICATION

This application claims the benefit of U.S. Provisional Patent Application, Ser. No. 63/624,095, filed on 23 Jan. 2024. The provisional application is hereby incorporated by reference herein in its entirety and is made a part hereof, including but not limited to those portions which specifically appear hereinafter.

BACKGROUND OF THE INVENTION

Field of the Invention

This invention relates generally to a theft deterrent system to protect items on retail shelves.

Description of Prior Art

A growing problem for retail stores is theft of high value inventory directly from shelves. Thieves target retail stores to remove valuable product for personal use, to later return it for cash, and/or to sell it outright.

Solutions to this problem have included locking down high value product in vaults or cabinets that require store personnel to unlock and physically provide the product to the consumer. Other solutions include security wires that physically connect the product to store shelves or each other. These solutions also require store personnel to unlock and untether such product for the consumer. These solutions tend to discourage customers from purchases because of the extra effort and time required to examiner and attain a product for purchase.

One area of particular concern is products like fragrances, cosmetics, small electronics, and similar small high value products that a consumer may want to sample or engage with directly in order to gauge a potential purchase. Such items require presentation to the consumer in a way that permits engagement without allowing the consumer to relocate the product from the display.

A need therefore exists in a retail system to permit direct consumer engagement with a sample product while maintaining inventory under lock and key solutions. Optimally, the inventory of the sample product can be maintained in close proximity to the sample product so both the consumer and the store associate do not have to depart from the area of engagement and/or retrieve or search for product in different locations within the retail environment.

SUMMARY OF THE INVENTION

The invention generally relates to a theft deterrent system that can be used on a retail shelf to protect certain goods from theft while permitting a customer direct access to the good.

The general object of the invention can be attained, at least in part, through a theft deterrent system for mounting on a retail shelf that includes a channel assembly configured to attach to a retail shelf. One or more brackets may be positioned along the channel assembly and fixed within the channel assembly when the channel assembly is in a closed position. One or more corresponding stages may then be configured to connect to a retail product and each stage of the one or more stages is thereby attached to a respective bracket of the one or more brackets. In this manner, a consumer may grasp and inspect a consumer good on a retail shelf without separating the good from the shelf.

Other objects and advantages will be apparent to those skilled in the art from the following detailed description taken in conjunction with the appended claims and drawings.

DETAILED DESCRIPTION OF THE INVENTION

Figure 1:
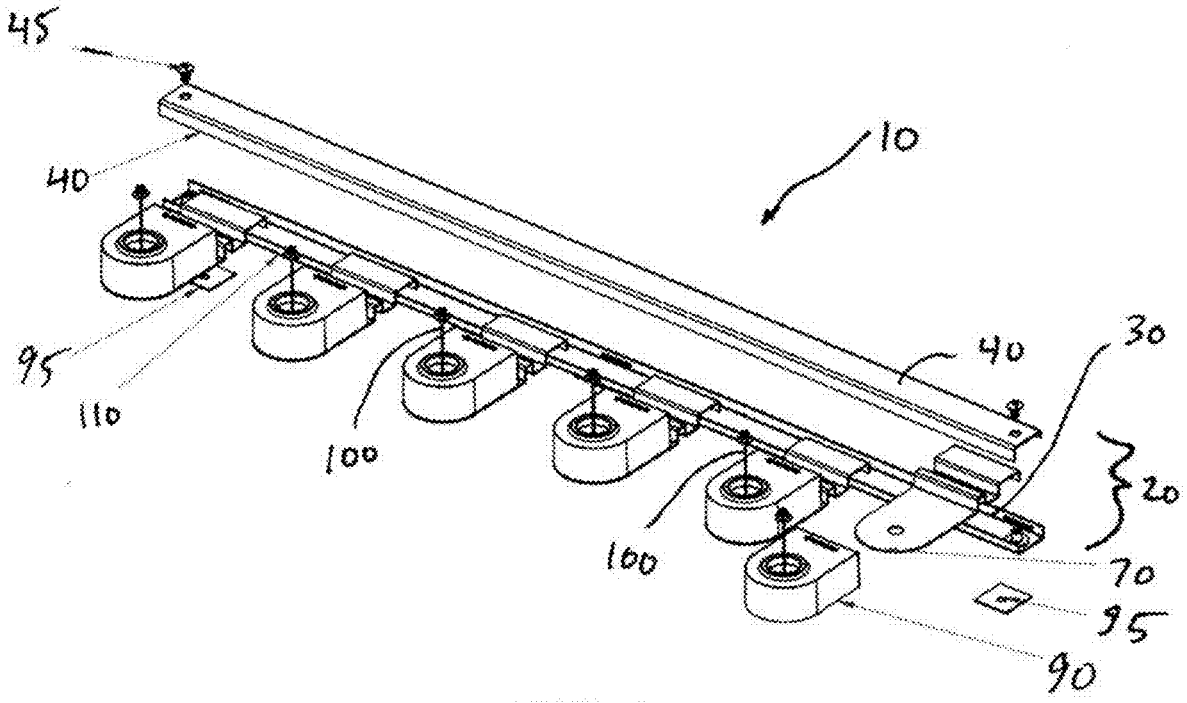
FIG. 1 shows a partially exploded perspective view of a theft deterrent system according to one embodiment of the invention.

The present invention provides a system including a one or more stages that are mountable relative to a retail shelf to prevent theft of various items. As used herein, a stage is a device for holding and displaying a product on a store shelf. Specifically, the stage is used to display a product in an interactive manner that permits a customer to touch, hold, operate, dispense, and/or try the product. The product may be a fragrance bottle, cosmetics, an electronic device, or any other consumer product or service that requires or encourages some tactile interaction with the customer. As such, each stage 90 preferably includes a retractable tether 100 and/or a manner of mounting the product to the stage 90 at the end of the tether 100 such as a set screw 110, adhesive, and/or a mount 120 positioned at an extendable end of the retractable tether 100.

FIGS. 1-13 show various embodiments of a theft deterrent system 10 for mounting on a retail shelf 15. Although the system 10 is particularly adaptable to a traditional store shelf 15, the system 10 is not limited to a traditional horizontal shelf arrangement and may be used in connection with any suitable retail display including a store fixture, a kiosk, a promotional display, a wall, a piece of furniture, and/or any other suitable setting a consumer may encounter. As such, the term "store shelf" is not intended to be limited to the shelves that you would find in the aisles of a grocery store.

As best shown in FIGS. 1-2 and 5-9, the system 10 preferably includes a channel assembly 20 configured to attach to the retail shelf 15. The channel assembly 20 is preferably attached to the retail shelf in a manner that is not removeable by consumers. A preferred manner of attaching the channel assembly 20 to the shelf 15 may include tape, adhesive, epoxy, fasteners, and/or a combination of the those so that the channel assembly 20 is firmly positioned in a desired location. It is desirable that the means of attaching the channel assembly 20 to the shelf is not visible to or accessible by the consumer so as to prevent tampering or detachment.

Figure 5:
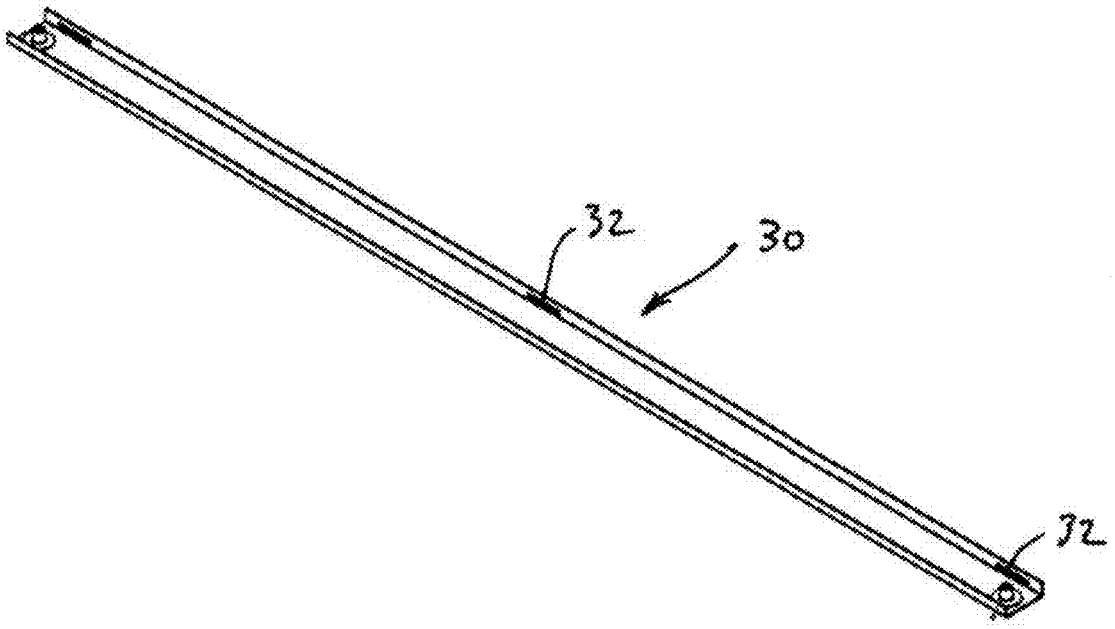
FIG. 5 shows a front perspective view of a lower channel according to one embodiment of the invention.
Figure 6:
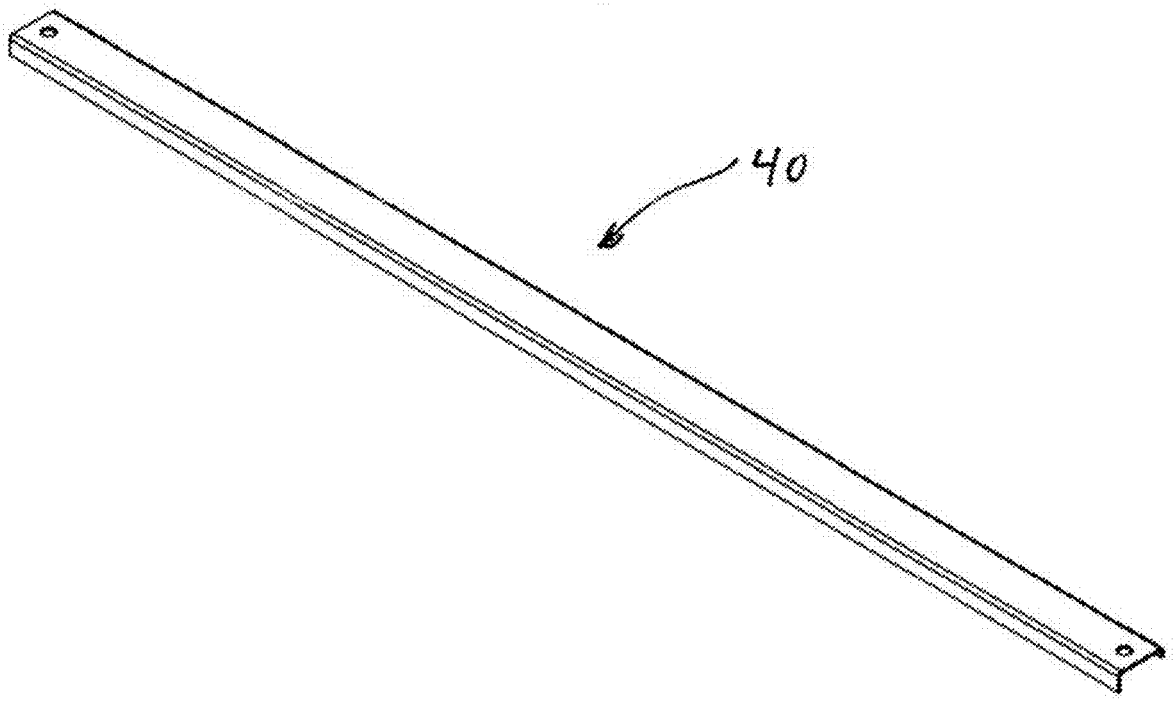
FIG. 6 shows a front perspective view of an upper channel according to one embodiment of the invention.
Figure 7:
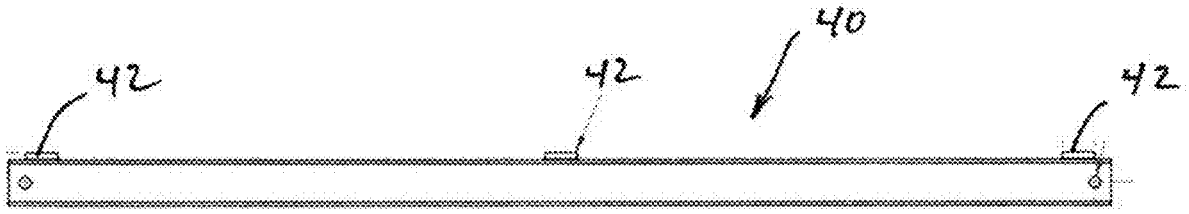
FIG. 7 shows a top view of an upper channel according to one embodiment of the invention.

As best shown in FIGS. 5-9, the channel assembly 20 may include a lower channel 30, as shown in one embodiment in FIG. 5, and a cooperative upper channel 40, as shown in one embodiment in FIGS. 6 and 7. The lower channel 30 and the upper channel 40 preferably together comprise the channel assembly 20. In one embodiment, the lower channel 30 is directly affixed or attached to the store shelf 15 and the upper channel is then attached to the lower channel 30 as described in more detail below.

Figure 8:
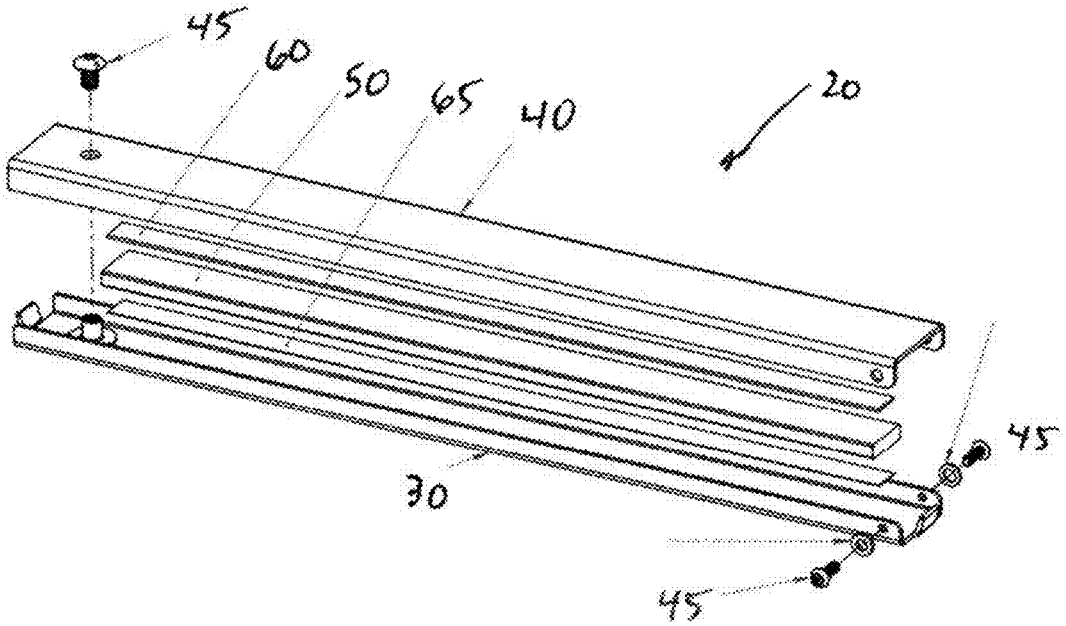
FIG. 8 shows an exploded perspective view of a channel assembly according to one embodiment of the invention.
Figure 9:
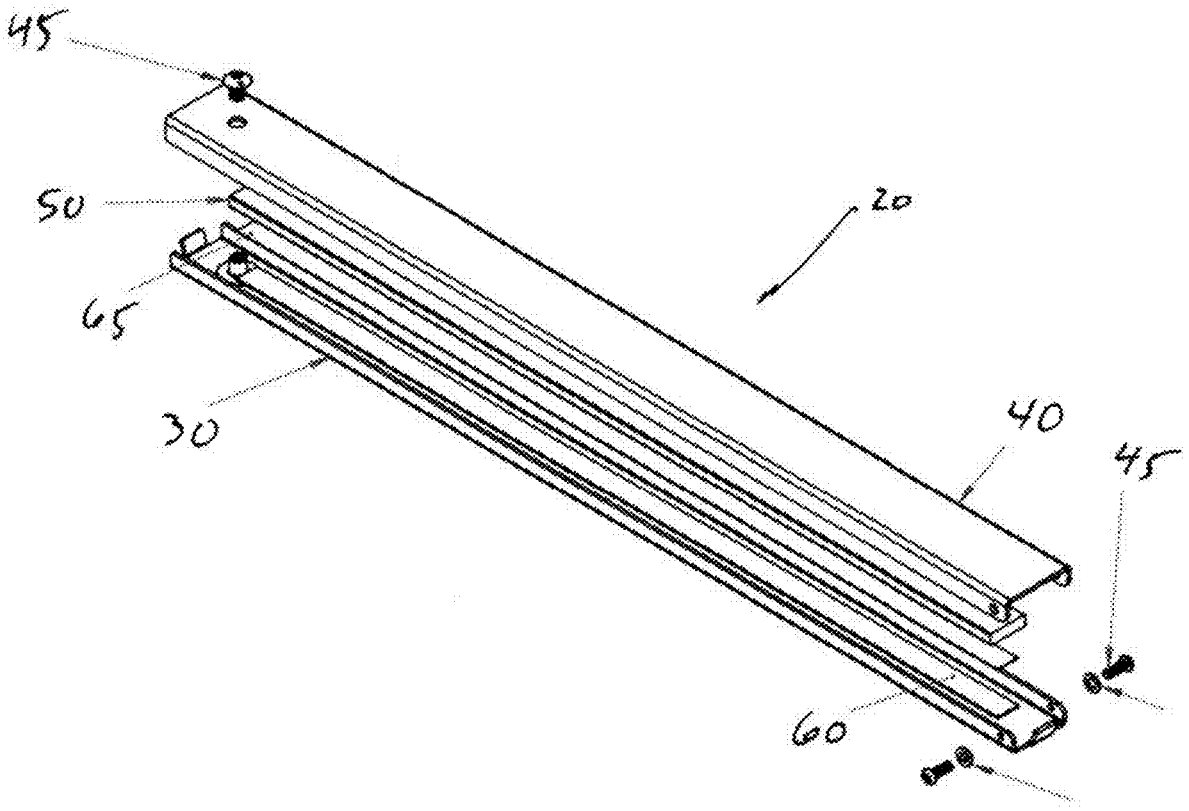
FIG. 9 shows an exploded perspective view of a channel assembly according to one embodiment of the invention.
Figure 10:
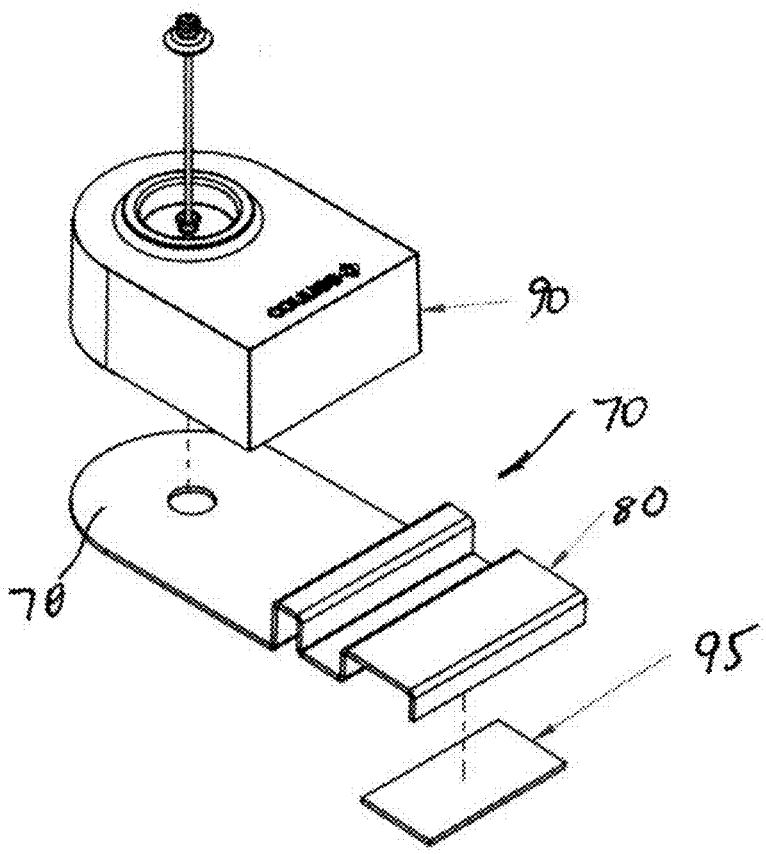
FIG. 10 shows an exploded perspective view of a stage and a bracket according to one embodiment of the invention.
Figure 11:
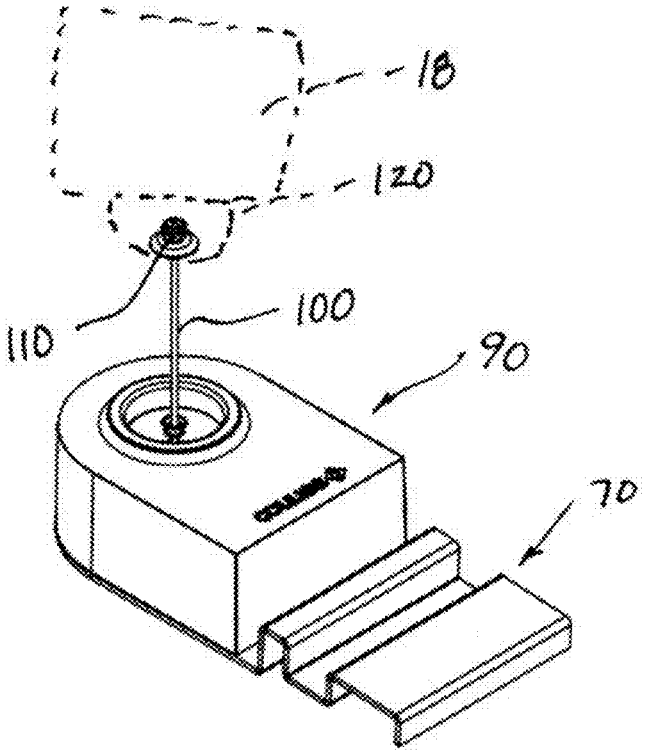
FIG. 11 shows an assembled perspective view of the stage and the bracket shown in FIG. 10.

According to one embodiment, the upper channel 40 may include one or more tabs 42 that are engageable with corresponding apertures 32 in the lower channel 30. In this way, the upper channel 40 may be properly centered over the lower channel. Alternatively or in addition, one or more fasteners 45 may connect the upper channel 40 to the lower channel 30. As shown in FIGS. 8 and 9, the fasteners 45 may include set screws that attach the upper channel 40 to the lower channel 40 through the top and/or from the sides. In the above described manner, the channel assembly 20 may assembled into a closed position on the store shelf 15 meaning the upper channel 40 is engaged with the lower channel 30 and locked into position through fasteners 45 and/or tabs 42 and apertures 32.

Figure 2:
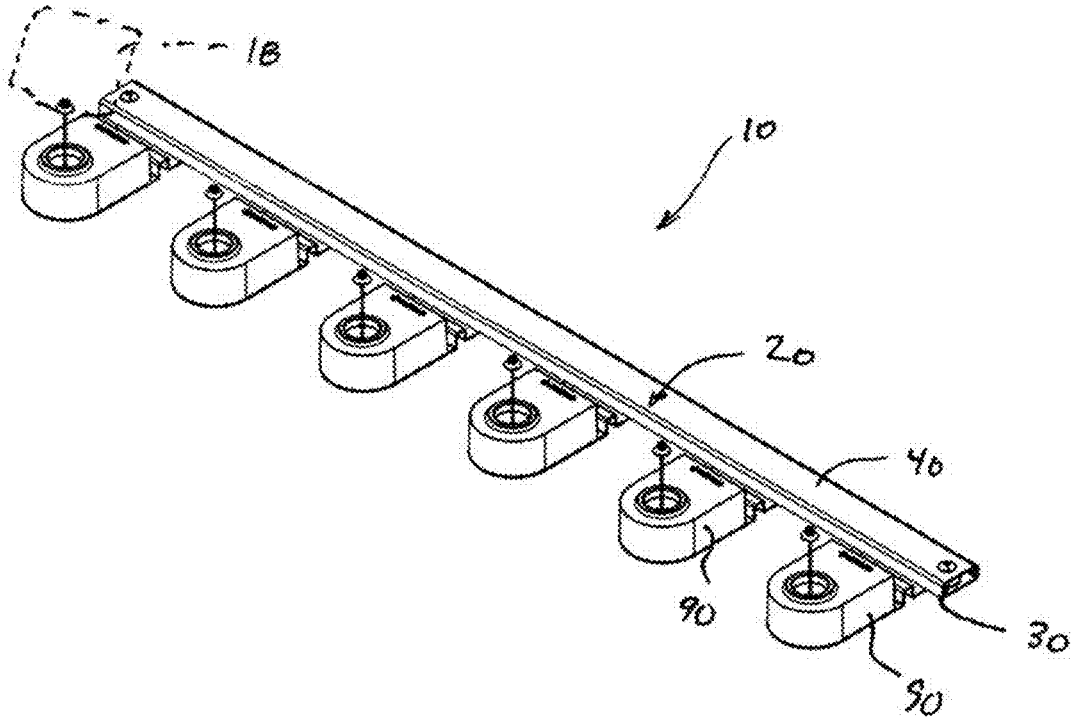
FIG. 2 shows a perspective view of a theft deterrent system according to the embodiment shown in FIG. 1.

According to embodiments, FIGS. 1-4 show one or more brackets 70 positioned along the channel assembly 20, the brackets 70 are preferably fixed within the channel assembly 20 when the channel assembly is in a closed position. Each bracket 70 is preferably configured to engage at least one stage 90. The stages 90 are in turn configured to connect to a retail product 18. Each stage 90 is thus attached to a respective bracket 70 within the channel assembly 20, as best shown in FIGS. 1 and 2.

Figure 3:
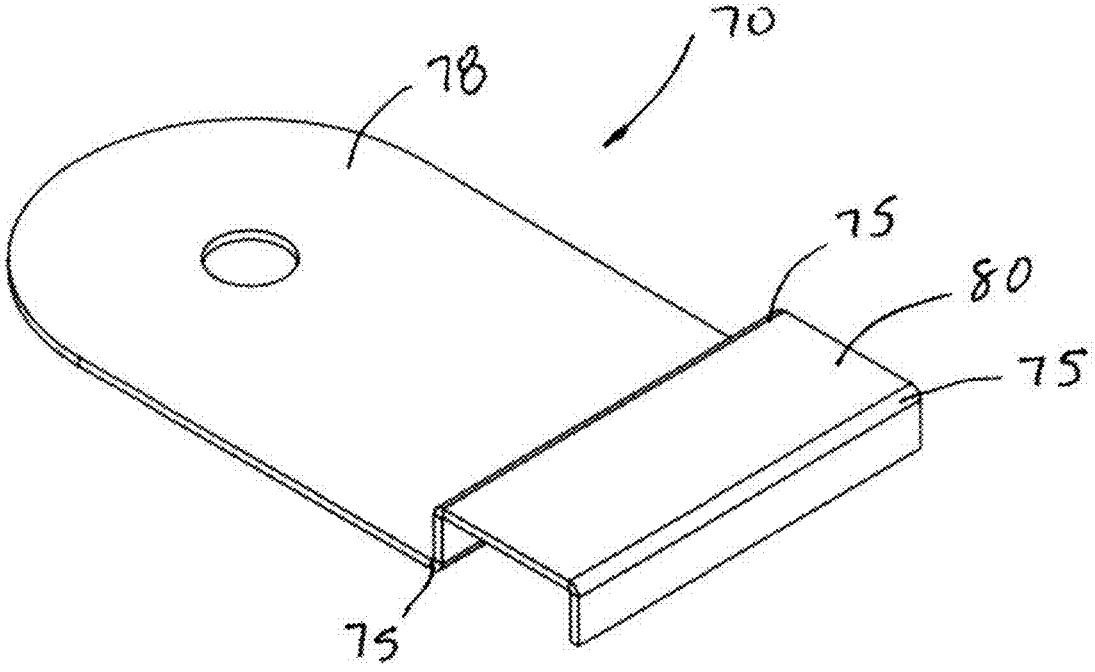
FIG. 3 shows a rear perspective view of a bracket according to one embodiment.
Figure 4:
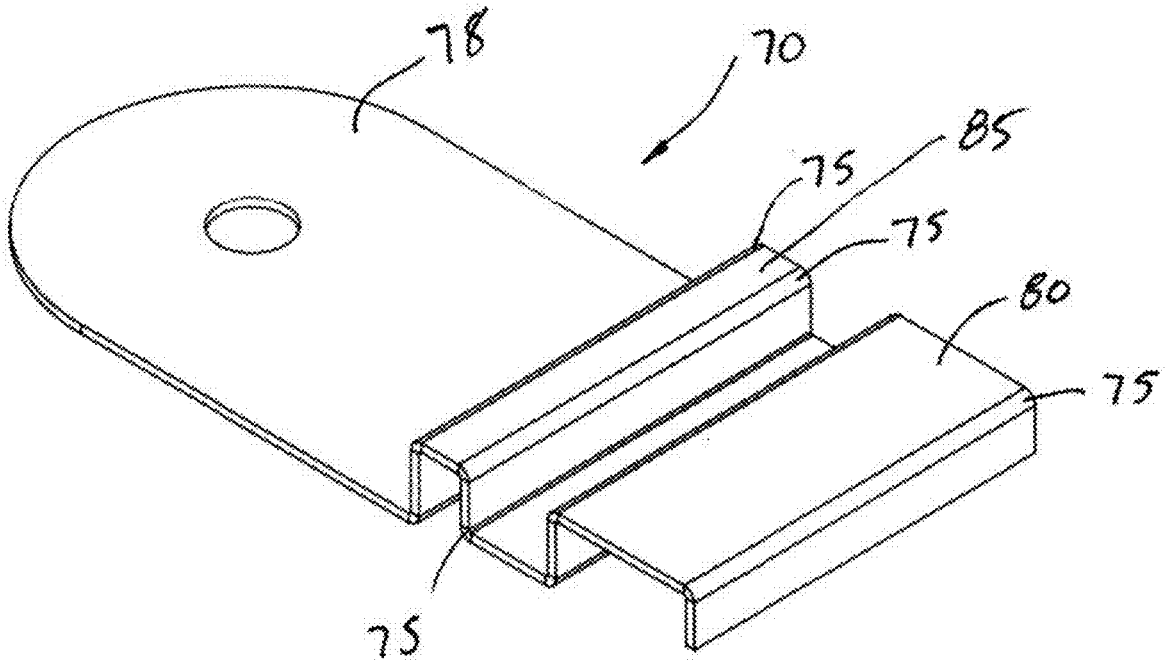
FIG. 4 shows a rear perspective view of a bracket according to one embodiment.

As described, the subject system preferably includes brackets 70 that are lockable between the lower channel 30 and the upper channel 40 of the channel assembly 20. Embodiments of the brackets 70 are shown in FIGS. 3 and 4. The brackets 70 preferably include one or more bends 75 that are configured to mate with the channel assembly 20. Each bracket 70 of the one or more brackets further includes an outwardly extending flat portion 78 connectable to a respective stage 90. The stage 90 may attach to the bracket with a fastener such as a screw and/or an adhesive pad 95.

In a preferred embodiment, the one or more bends 75 in each bracket 70 preferably form one or more bridges 80, 85. As shown in FIG. 3, the bracket 70 includes a single bridge 80. As shown in FIG. 4, the bracket 70 may include two bridges 80, 85. Preferably, in the bracket 70 shown in FIGS. 3 and 4, the bridge 80 spans at least a portion of the channel assembly 20 and the bridge 85 spans a portion of the retail shelf.

In one embodiment, best shown in FIGS. 8 and 9, a channel fence 50 is positioned between the upper channel 40 and the lower channel 30 of the channel assembly 20. In one embodiment, the channel fence 50 comprises a rod having a rectangular cross-section. The channel fence 50 preferably mates within a bend 75 and/or bridge 80 of each bracket 70 of the one or more brackets 70. The channel fence 50 is thus sized and configured to extend through the channel assembly 20 so that one or more brackets 70 mate with the channel assembly 20 and the channel fence 50.

In addition, as best shown in FIGS. 8 and 9, one or more adhesive strips 65 may be positioned between the channel fence 50 and the upper channel 40 and/or the lower channel 30 to maintain position of the channel fence 50. In addition, one or more layers of a hook and loop strip 60 may be placed relative to the channel fence 50. Such hook and loop strip 60 may assist in preventing movement of the brackets 70 within the channel assembly 20.

The one or more brackets 70 positioned along the channel assembly 20 may be slideable relative to the channel assembly 20 but not removeable from the channel assembly 20 when the channel assembly 20 is in a closed position. More preferably, the brackets 70 are slideable before the channel assembly 20 is fully engaged it the closed position but then fully locked into position once the channel assembly 20 is fastened into the closed position. In this manner, a retail store can position stages 90 in desired positions along each channel assembly 20 depending on spatial limitation and shelf space to create custom displays of one or more retail products and once the stages 90 are placed in desired positions, consumers cannot easily disturb the intended layout. In this manner, inventory of the retail product can be stored in association with the displayed retail product to enable a consumer to directly find the inventory of the retail product on the respective stage 90.

FIGS. 8 and 9 also show a hinged arrangement of the channel assembly 20 having one or more transversely aligned fasteners 45 at one end of the channel assembly 20. In this way, the channel assembly 20 can be opened along its length without requiring complete separation to permit movement or realignment of the brackets 70 along a length of the channel assembly 20. In embodiments of the subject invention, it is preferable that the brackets 70 are only moveable when the channel assembly 20 is separated, at least partially, between the upper channel 40 and the lower channel 30.

Figure 12:
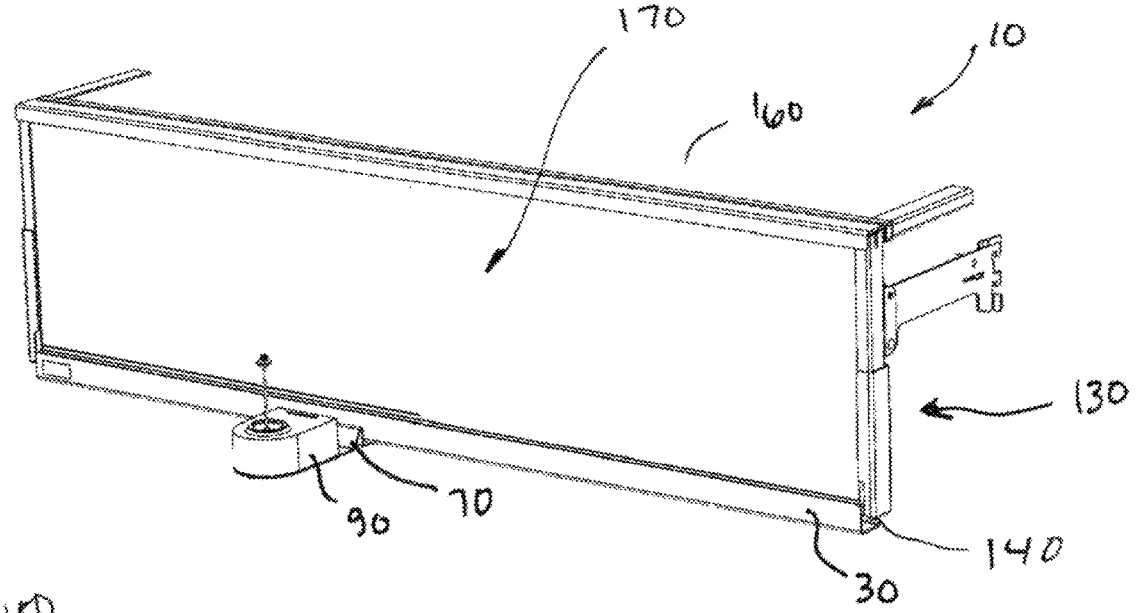
FIG. 12 shows an assembled perspective view of a theft deterrent system including an integrated cabinet.
Figure 13:
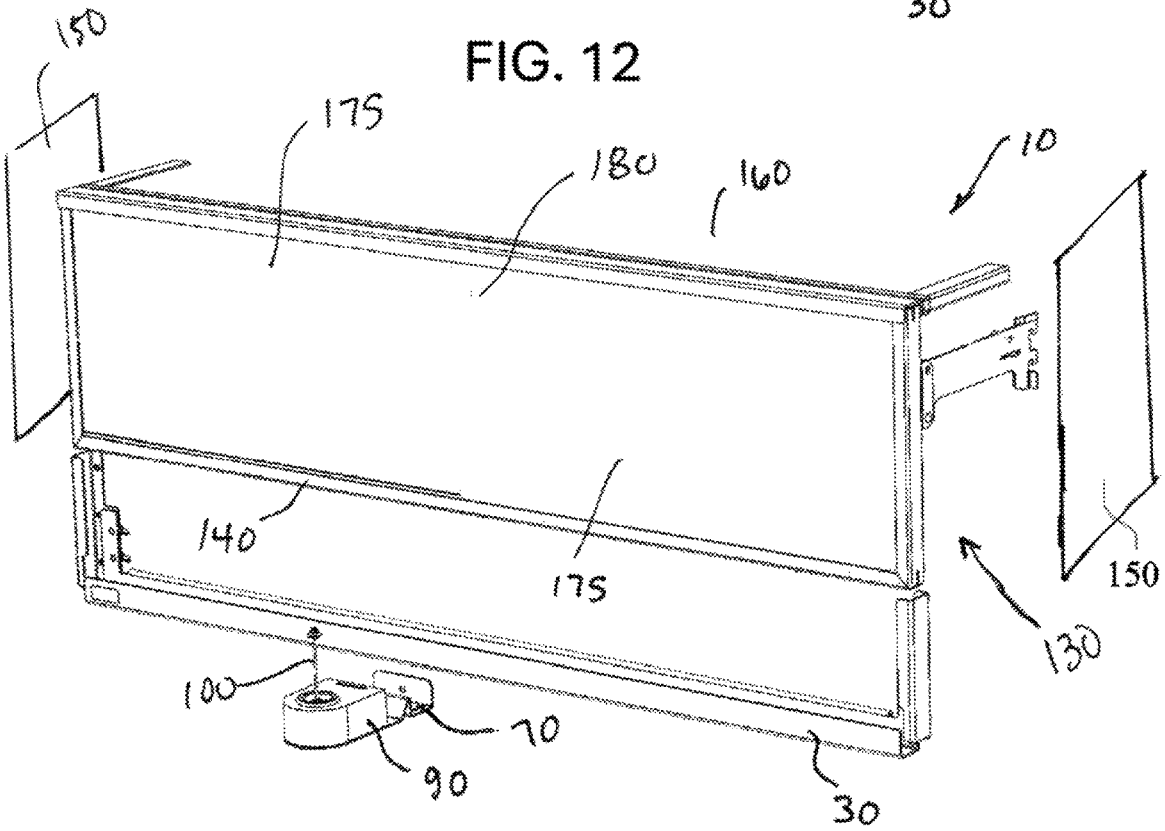
FIG. 13 shows an exploded view of the theft deterrent system shown in FIG. 12.

According to a preferred embodiment shown in FIGS. 12 and 13, the theft deterrent system 20 further includes an integrated cabinet 130 formed behind the channel assembly 20 wherein the integrated cabinet 130 is engaged with the channel assembly 20 and attached to the retail shelf 15. The integrated cabinet 130 preferably contains inventory of the retail product that is displayed on the respective stage 90 or stages 90.

The integrated cabinet 130 preferably includes a lower crossbar 140 engageable with the channel assembly 20. The integrated cabinet 130 may further include shelf brackets for engaging with conventional shelf uprights on the respective retail shelf 15.

The integrated cabinet 130 preferably further includes two side panels 150, a top panel 160, and an openable front panel 170. In this manner, all sides of the retail shelf 15 are protected from unauthorized access. The integrated cabinet 130 preferably further includes the openable front panel 170 comprising one or more lockable sliding doors 175 and a lock 180. The lockable sliding doors 175 are preferably transparent to enable a consumer and a retail associate to identify the inventory within the integrated cabinet 130 and desirably placed behind the sample retail product fastened to a respective stage 90. In this manner, a consumer can sample the retail product affixed to the stage 90 and then obtain assistance from a retail associate to obtain protected inventory from within the integrated cabinet 130.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A theft deterrent system for mounting on a retail shelf, the theft deterrent system comprising:

a channel assembly configured to attach to a retail shelf, wherein the channel assembly includes a lower channel and a separate upper channel that are mateable with respect to each other;

a separate channel fence positioned within and extending between the upper channel and the lower channel;

one or more brackets positioned along the channel assembly, the brackets fixed within the channel assembly when the channel assembly is in a closed position;

one or more layers of a hook and loop strip positioned relative to the channel fence; and one or more stages configured to connect to a retail product, each stage of the one or more stages attached to a respective bracket of the one or more brackets.

2. The theft deterrent system of claim 1 wherein the upper channel is fastened to the lower channel.

3. The theft deterrent system of claim 1 wherein the channel fence mates within a bend of each bracket of the one or more brackets.

4. The theft deterrent system of claim 1 wherein the one or more brackets are lockable between the lower channel and the upper channel.

5. The theft deterrent system of claim 1 wherein the one or more brackets include one or more bends that mate with the channel assembly.

6. The theft deterrent system of claim 5 wherein the channel fence extends through the channel assembly and wherein the one or more brackets mate with the channel assembly and the channel fence.

7. The theft deterrent system of claim 1 wherein the stage further includes a retractable tether.

8. The theft deterrent system of claim 7 further comprising one of a set screw and a mount positioned at an end of the retractable tether.

9. The theft deterrent system of claim 1 wherein each bracket of the one or more brackets includes an outwardly extending flat portion connectable to a respective stage and one or more bends forming a bridge that extends through the channel assembly.

10. The theft deterrent system of claim 1 wherein the one or more brackets are slideable relative to the channel assembly but not removable from the channel assembly when the channel assembly is in the closed position.

11. A theft deterrent system for mounting on a retail shelf, the theft deterrent system comprising:

a channel assembly configured to attach to a retail shelf, wherein the channel assembly includes a lower channel and a distinct cooperative upper channel;

a separate channel fence positioned within and extending between the lower channel and the upper channel;

one or more brackets positioned along the channel assembly, the brackets slideable relative to the channel assembly but not removeable from the channel assembly when the channel assembly is in a closed position, wherein the one or more brackets include one or more bends that mate with the channel assembly and/or the channel fence; and one or more stages configured to connect to a retail product, each stage of the one or more stages attached to a respective bracket of the one or more brackets.

12. The theft deterrent system of claim 11 wherein the upper channel is hinged relative to the lower channel.

13. The theft deterrent system of claim 11 wherein the one or more brackets are lockable between the lower channel and the upper channel.

14. The theft deterrent system of claim 11 wherein the channel fence comprises a rod having a rectangular cross-section.

15. The theft deterrent system of claim 11 wherein the one or more bends include multiple bends forming two bridges.

16. The theft deterrent system of claim 15 wherein one bridge spans at least a portion of the channel assembly and one bridge spans a portion of the retail shelf.

17. The theft deterrent system of claim 11 further comprising an integrated cabinet formed behind the channel assembly wherein the integrated cabinet is engaged with the channel assembly and attached to the retail shelf.

18. The theft deterrent system of claim 17 wherein the integrated cabinet includes an openable front panel comprising one or more lockable sliding doors.

19. The theft deterrent system of claim 18 wherein the one or more lockable sliding doors are transparent.

20. The theft deterrent system of claim 17 wherein inventory of the retail product is contained on the retail shelf within the integrated cabinet.

21. The theft deterrent system of claim 17 wherein the integrated cabinet comprises a lower crossbar engageable with the channel assembly, two side panels, a top panel, and an openable front panel.

* * * * *